US007507094B2

(12) United States Patent
Kubota et al.

(10) Patent No.: US 7,507,094 B2
(45) Date of Patent: Mar. 24, 2009

(54) ELECTRICAL CONNECTION BOX AND ASSEMBLING METHOD OF ELECTRICAL CONNECTION BOX

(75) Inventors: Katsuhiro Kubota, Kakegawa (JP); Keisuke Ozawa, Kakegawa (JP); Tomohiro Sugiura, Kakegawa (JP); Katsuyoshi Kobayashi, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/970,927

(22) Filed: Jan. 8, 2008

(65) Prior Publication Data

US 2008/0166909 A1 Jul. 10, 2008

(51) Int. Cl.
*H01R 12/00* (2006.01)

(52) U.S. Cl. ..... 439/76.2

(58) Field of Classification Search ..... 439/76.2, 439/342, 343, 326

See application file for complete search history.

(56) References Cited

U.S. PATENT DOCUMENTS

| | | | | |
|---|---|---|---|---|
| 5,848,902 | A * | 12/1998 | Yamaguchi et al. | 439/34 |
| 6,683,950 | B1 * | 1/2004 | Harwood et al. | 379/413.02 |
| 6,923,660 | B2 * | 8/2005 | Takeuchi | 439/76.2 |
| 6,929,489 | B2 * | 8/2005 | Asao et al. | 439/140 |
| 7,037,124 | B2 * | 5/2006 | Lee et al. | 439/157 |
| 2004/0043647 | A1 * | 3/2004 | Takeuchi | 439/76.2 |
| 2006/0216965 | A1 * | 9/2006 | Yamanishi et al. | 439/76.1 |
| 2006/0234528 | A1 * | 10/2006 | Nakano et al. | 439/76.2 |
| 2008/0119066 | A1 * | 5/2008 | Shimizu et al. | 439/76.1 |
| 2008/0119068 | A1 * | 5/2008 | Shimizu et al. | 439/76.2 |
| 2008/0254654 | A1 * | 10/2008 | Ito | 439/76.2 |

FOREIGN PATENT DOCUMENTS

| | | | |
|---|---|---|---|
| JP | 9-163552 | A | 6/1997 |
| JP | 2001-78329 | A | 3/2001 |
| JP | 2003-9347 | A | 1/2003 |
| JP | 2005-176539 | A | 6/2005 |
| JP | 2006-187052 | A | 7/2006 |

* cited by examiner

*Primary Examiner*—Ross N Gushi
(74) *Attorney, Agent, or Firm*—Sughrue Mion, PLLC

(57) ABSTRACT

An electrical connection box includes a body which includes a mounting surface and a mounting member, including a shaft portion, attached to the body. The body includes a bearing portion which receives the shaft portion rotatably. The bearing portion has a receiving portion which receives the shaft portion, a limiting portion provided at a position separate from the mounting surface for a predetermined distance, and an insertion port, having a length of the predetermined distance defined by the mounting surface and the limiting portion, through which the shaft portion is inserted into the receiving portion. The limiting portion limits a movement of the shaft portion in a direction parallel to the mounting surface based on an inclining condition of the mounting member.

9 Claims, 11 Drawing Sheets

ELECTRICAL CONNECTION BOX AND ASSEMBLING METHOD OF ELECTRICAL CONNECTION BOX

BACKGROUND

This invention relates to an electrical connection box to be mounted on a vehicle or the like and an assembling method of the electrical connection box, and more particularly to an electrical connection box in which a body and a mounting member are connected together at their one ends through a hinge, and the body and the mounting member are positioned relative to each other for attaching purposes by the hinge, and are connected together in a superposed manner.

An electrical connection box for mounting on an automobile or the like includes a plurality of boards on which electronic parts, power bus bars, etc., are mounted. In order to protect the boards and also to enhance the efficiency of an assembling operation in the production and the efficiency of an operation for exchanging the board in the event of a malfunction, each board is beforehand received within a board case (serving as a mounting member) or a body, and the board case and the body are connected together to provide the electrical connection box.

For example, an electrical connection box disclosed in Patent Literature 1 includes a first board case (that is, a mounting member) having a board (on which a plurality of electronic parts are mounted) received within a housing, and a second board case (that is, a body) having a board (on which a circuit for connection to the plurality of electronic parts is formed) received within a housing. When the first board case and the second board case are superposed together, connectors mounted respectively on the two boards are fitted to each other to be electrically connected to each other, and also retaining portions provided respectively at the two housings are engaged with each other, thereby fixing the two board cases to each other.

An electrical connection box 100 disclosed in Patent Literature 2 and shown in FIG. 14 includes a body 102, and a cover 101 (that is, a mounting member), and a body-side hook 112 and a cover-side hook 111 are formed respectively at end portions of the body 102 and the cover 101. The cover-side hook 111 is inserted through an insertion port 120, and is engaged with the body-side hook 112, thereby forming a hinge mechanism 110. In this condition, when the cover 101 is moved toward the body 102, the cover-side hook 111 is pivotally moved relative to the body-side hook 112, and a cover-side position limitation groove 121 is fitted on a distal end portion of a peripheral wall 122 of the body 102 during this operation, so that the position of the cover 101 is limited, that is, the cover 101 is properly positioned relative to the body 2, and in this condition the cover 101 is attached to the body 102.

[Patent Literature 1] JP-A-2003-9347

[Patent Literature 2] JP-A-09-163552

However, in the electrical connection box of Patent Literature 1, there is not provided any guide means for positioning the board cases, and it is very difficult to properly position the board cases when combining these board cases together, and it is necessary to carefully effect this operation so that the connectors can be accurately fitted together, and therefore there has been encountered a problem that the efficiency of the operation is very low. And besides, when the connectors are fitted together in an improperly-positioned condition, there has been encountered a problem that the connectors strike against each other, and therefore are subjected to deformation or damage. Furthermore, when the board cases are combined together in such a deformed condition, there has been encountered a problem that a defective assembly is produced.

In the electrical connection box of Patent Literature 2, the cover-side hook 111 is inserted into the insertion port 120 in the body to thereby form the hinge mechanism 110, and the cover is pivotally moved about the hinge mechanism 110, and therefore the positioning of the cover and the body relative to each other for attaching purposes can be effected accurately. However, the insertion port 120 in the body is narrow, and besides there is provided no guide means for guiding the insertion of the cover-side hook 111, and therefore the insertion of the cover-side hook 111 is difficult, which has invited a problem that the efficiency of the operation is low.

SUMMARY

With the above problems in view, it is an object of this invention to provide an electrical connection box in which when assembling the electrical connection box, a body and a mounting member to be attached thereto can be accurately and easily positioned relative to each other, and an assembling method of the electrical connection box.

The above object has been achieved by an electrical connection box of the invention including:

- a body which includes a mounting surface; and
- a mounting member, including a shaft portion, attached to the body,
- wherein the body includes a bearing portion which receives the shaft portion rotatably;
- wherein the bearing portion has:
  - a receiving portion which receives the shaft portion;
  - a limiting portion provided at a position separate from the mounting surface for a predetermined distance; and
  - an insertion port, having a length of the predetermined distance defined by the mounting surface and the limiting portion, through which the shaft portion is inserted into the receiving portion; and
- wherein the limiting portion limits a movement of the shaft portion in a direction parallel to the mounting surface based on an inclining condition of the mounting member.

Preferably, the mounting member includes a contact surface face-contacted with the mounting surface when the mounting member is attached to the body, and the shaft portion is provided far from the contact surface in a direction perpendicular to the contact surface.

Preferably, the limiting portion allows the inserting movement of the shaft portion in which the shaft portion is inserted into the receiving portion in a first inclining condition of the mounting member and limits the inserting movement of the shaft portion in a second inclining condition of the mounting member.

Here, it is preferable that in the first inclining condition, an angle of the mounting member to the mounting surface is larger than a predetermined angle so that a distance between a top of the shaft portion and the mounting surface is smaller than the length of the insertion port.

Here, it is preferable that in the second inclining condition, an angle of the mounting member to the mounting surface is smaller than or equal to a predetermined angle so that a distance between a top of the shaft portion and the mounting surface is longer than the length of the insertion port.

Preferably, the body includes a first printed circuit board having a first connector mounted thereon, and the mounting member includes a second printed circuit board having a second connector mounted thereon, and when the mounting member is attached to the body, the first connector is mated to the second connector to electrically connect the first printed circuit to the second printed circuit.

Preferably, the shaft portion has a reinforcing unit interposed between the shaft portion and the mounting member to reinforce the shaft portion.

The above object has been also achieved by an assembling method of an electrical connection box, comprising:

providing a body which includes a mounting surface and a bearing portion, the bearing portion having a limiting portion; and providing a mounting member which includes a shaft portion;

sliding the mounting member toward the bearing portion along the mounting surface of the body to insert the shaft portion into the bearing portion; and rotating the mounting member to a direction of the mounting surface about the shaft portion so as to attach the mounting member to the body.

Preferably, in the sliding process, the mounting member is inclined in a condition in which an angle of the mounting member to the mounting surface is set to be larger than a predetermined angle.

In the above configuration and process, the body and the mounting member are connected together by the hinge formed by the shaft portion and the bearing portion, and the bearing portion has the insertion port through which the shaft portion, while sliding over the mounting surface toward the bearing portion, passes. Therefore, when assembling the electrical connection box, the shaft portion of the mounting member is slid over the mounting surface of the body toward the insertion port, and by doing so, the shaft portion can be inserted into the receiving portion through the insertion port. Therefore, the positioning for the purpose of passing the shaft portion through the insertion port can be easily effected, that is, the initial positioning of the body and the mounting member relative to each other can be easily effected, and therefore the efficiency of an operation for assembling the electrical connection box can be enhanced. Furthermore, the bearing portion includes the receiving portion for receiving the shaft portion passed through the insertion port, and the limiting portion for preventing the shaft portion from being disengaged from the receiving portion when the mounting member is pivotally moved. Therefore, even when the mounting member is pivotally moved about the hinge after the shaft portion is inserted into the receiving portion, the shaft portion is held in position by the limiting portion, and will not be disengaged from the receiving portion, so that the body and the mounting member are kept in their proper mounting positions, and therefore the efficiency of the operation for assembling the electrical connection box can be enhanced.

In the above configuration and process, the shaft portion is formed on the mounting member in such a manner that when the shaft portion is slid toward the bearing portion while the mounting member is kept inclined relative to the mounting surface at the angle smaller than or equal to the predetermined angle, the shaft portion is prevented from passing through the insertion port. Therefore, in order that the shaft portion can pass through the insertion port to be inserted into the bearing portion, the angle of inclination of the mounting member need to be larger than the above predetermined angle. Namely, the mounting member is inclined at such an angle that the shaft portion can pass through the insertion port to be inserted into the bearing portion, and by doing so, the angle of inclination of the mounting member is necessarily larger than the above predetermined angle, and parts mounted on and projecting from the opposed surfaces of the body and the mounting member are prevented from striking against each other. Therefore, damage of the parts due to an error during the assembling operation of the electrical connection box can be avoided, and therefore the operation for assembling the electrical connection box can be positively effected.

In the above configuration and process, the printed circuit board having the connector mounted thereon is received within the body, while the printed circuit board having the connector mounted thereon is received within the mounting member, and simultaneously when the mounting member is mounted on the mounting surface of the body in superposed relation thereto, the two connectors are fitted together. Therefore, simultaneously when the body and the mounting member are connected together by the hinge, and are positioned relative to each other for mounting purposes, the connectors are also positioned relative to each other. Therefore, simultaneously when the electrical connection box is assembled, the two connectors are fitted together. At this time, the two connectors are accurately fitted together without striking against each other and therefore without being damaged, and therefore the efficiency of the operation for assembling the electrical connection box can be enhanced.

In the above configuration and process, the shaft portion has the reinforcing unit which is interposed between the shaft portion and the mounting member to reinforce the shaft portion. Therefore, the strength of the shaft portion can be increased by the reinforcing unit, and therefore the strength of the hinge can be increased, and the assembled condition of the body and the mounting member can be more positively maintained.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF PREFERRED EMBODIMENTS

Figure 1:
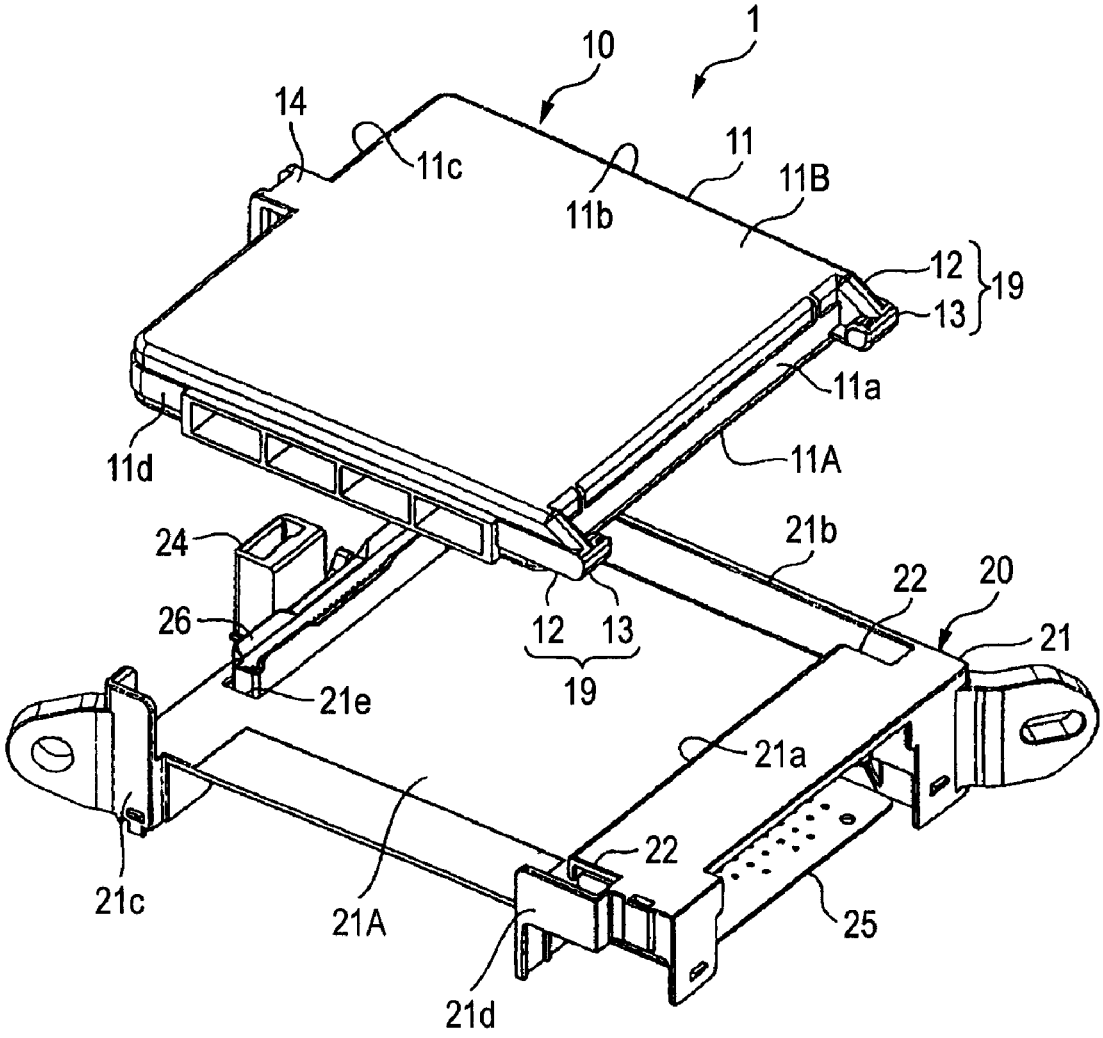
FIG. 1 is a perspective view showing one preferred embodiment of an electrical connection box of the present invention.
Figure 2:
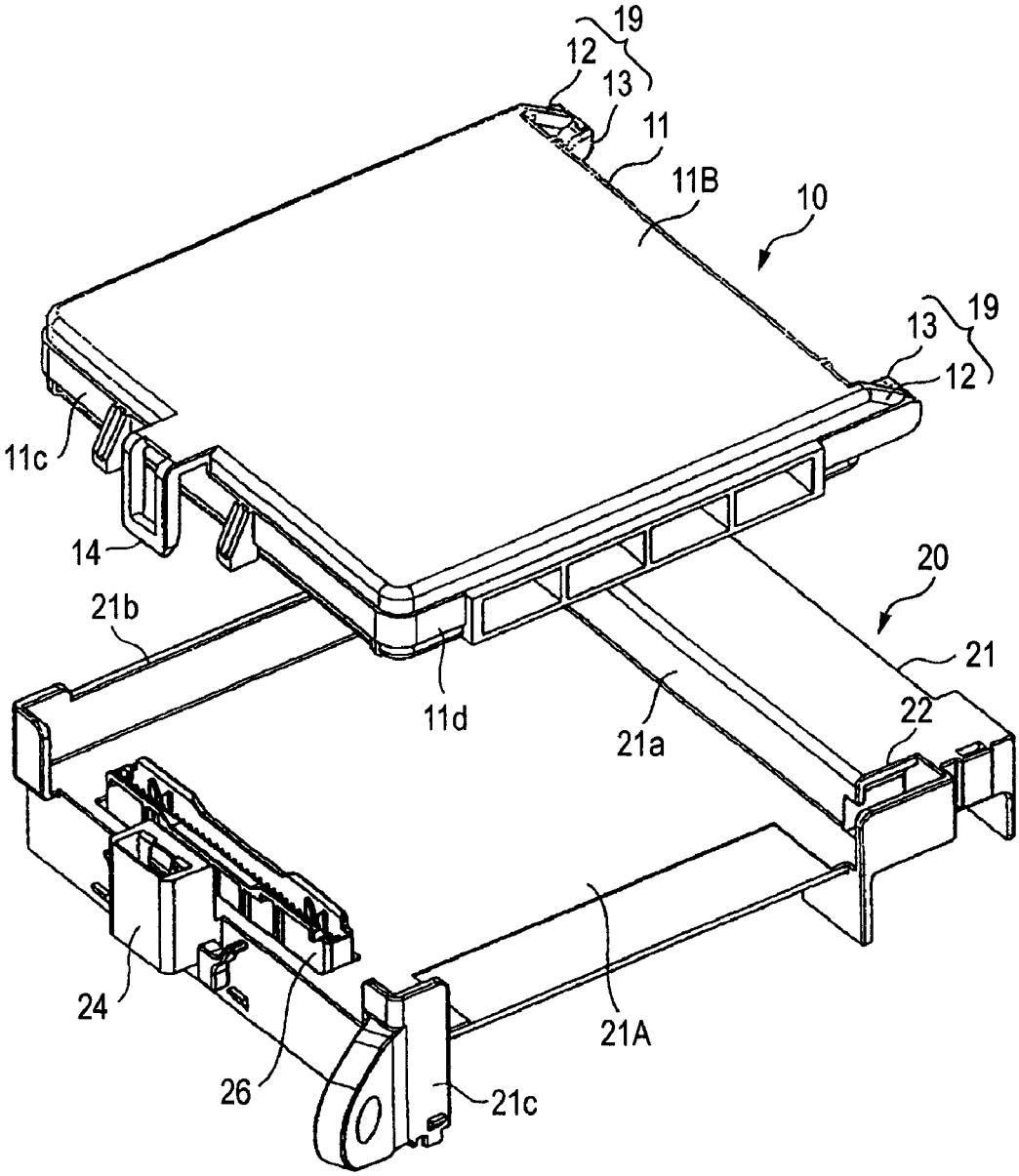
FIG. 2 is a perspective view of the electrical connection box as seen from an angle different from that of FIG. 1.
Figure 3:
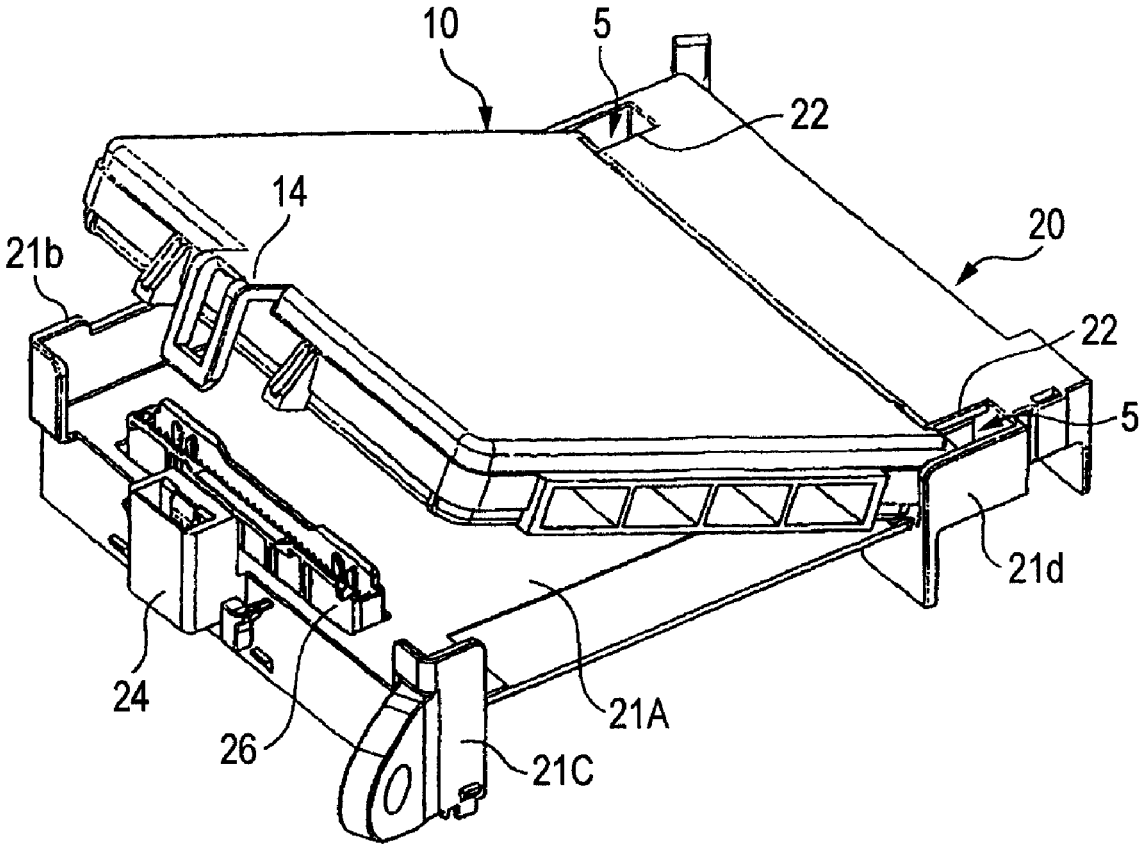
FIG. 3 is a perspective view of the electrical connection box, showing a condition in which shaft portions are inserted respectively in bearing portions.
Figure 4:
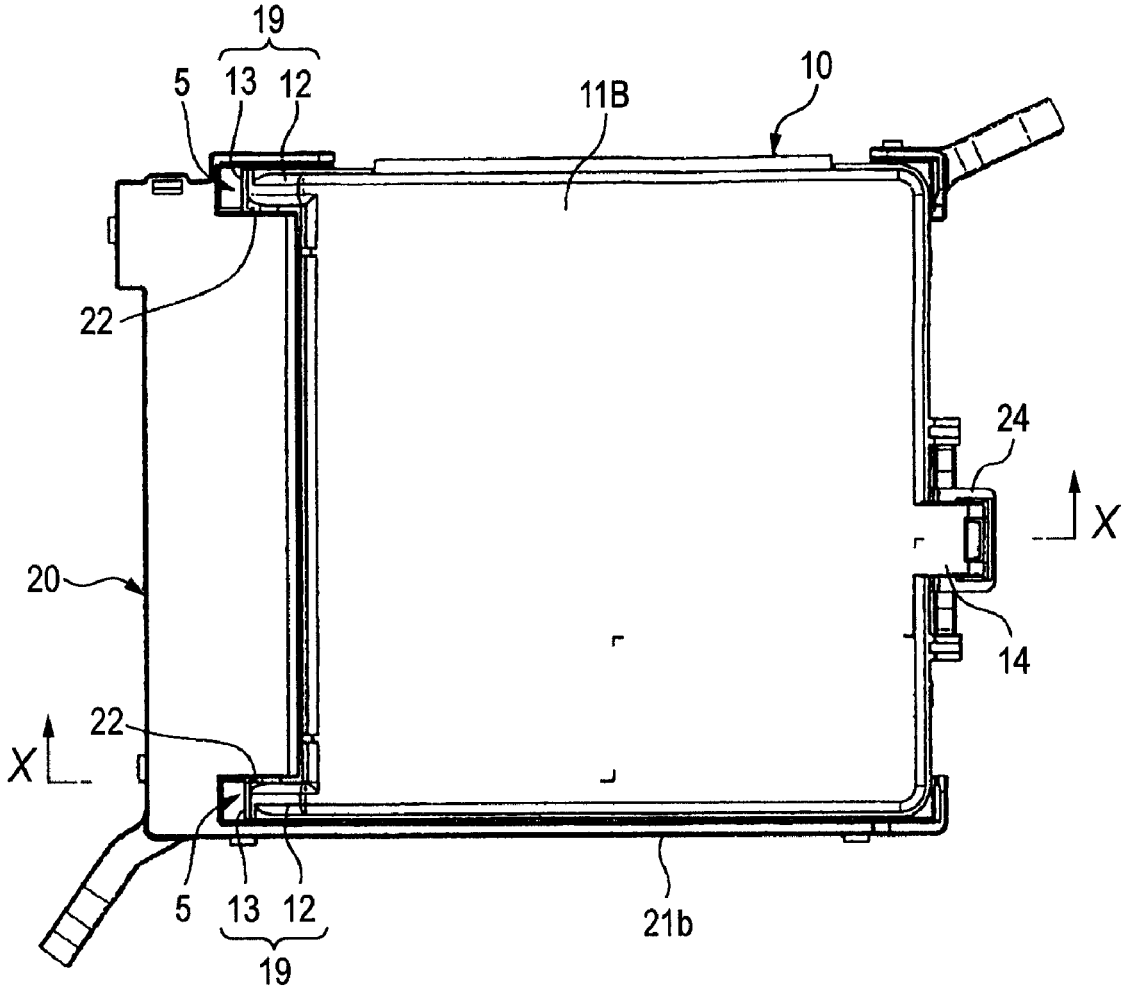
FIG. 4 is a top plan view of the electrical connection box as seen from an upper side of a mounting member, showing a condition in which the mounting member is attached to a body.
Figure 13:
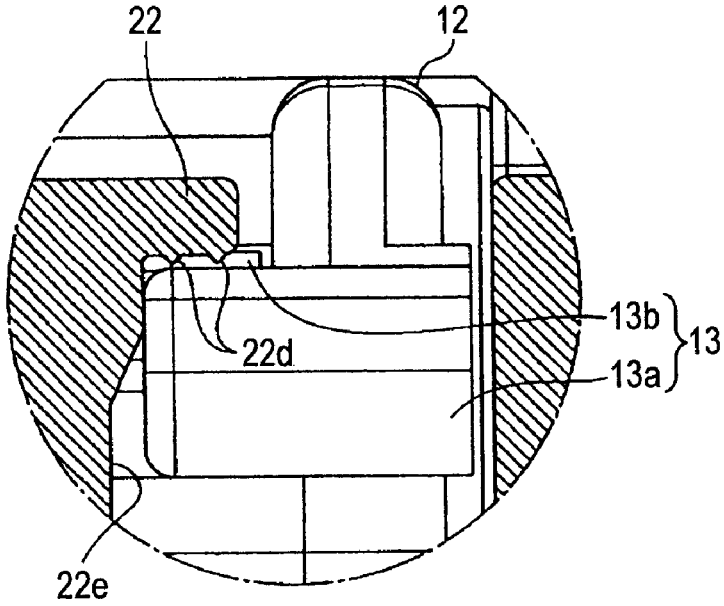
FIG. 13 is a cross-sectional view taken along the line Y-Y of FIG. 8.
Figure 14:
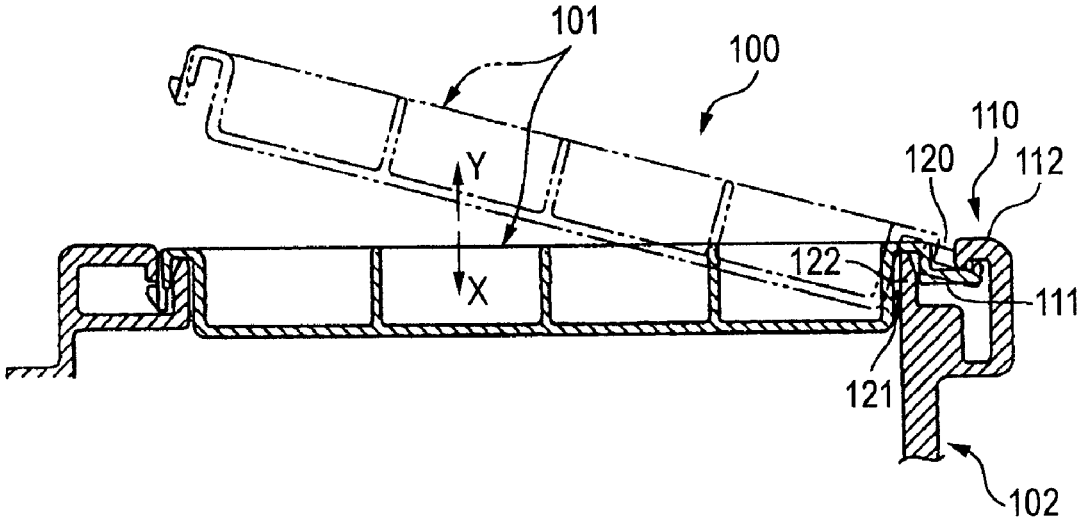
FIG. 14 is a cross-sectional view of an important portion of a conventional electrical connection box.

FIG. 1 is a perspective view showing one preferred embodiment of an electrical connection box of the present invention. FIG. 2 is a perspective view of the electrical connection box as seen from an angle different from that of FIG. 1. FIG. 3 is a perspective view of the electrical connection box showing a condition in which shaft portions are inserted respectively in bearing portions. FIG. 4 is a top plan view of the electrical connection box as seen from an upper side of a mounting member, showing a condition in which the mounting member is attached to a body. FIGS. 5 to 8 are cross-sectional views taken along the line X-X of FIG. 4, showing a series of operations from the step of inserting the shaft portions into the respective bearing portions to the step of attaching the mounting member to the body. FIGS. 9 to 12 are enlarged views of a hinge portion of FIGS. 5 to 8. FIG. 13 is a cross-sectional view taken along the line Y-Y of FIG. 8. FIG. 14 is a cross-sectional view of an important portion of a conventional electrical connection box.

One preferred embodiment of the electrical connection box of the invention will now be described with reference to FIGS. 1 to 13. As shown in FIG. 1, the electrical connection box 1 includes the body 20, and the mounting member 10 to be attached to the body 20. The mounting member 10 is an electronic control unit (also called an ECU which is an abbreviation of an Engine Control Unit or an Electronic Control Unit) of a vehicle. When the mounting member 10 is attached to the body 10 to be electrically connected thereto, this mounting member 10 is supplied with electric power from the body 2, and also controls electronic parts (such as relays and others) mounted within the body 20. The body 20 and the mounting member 10 are pivotally or rotatably and releasably connected together by the hinges 5 (see FIG. 3).

The hinge 5 includes the shaft portion 19 formed on the mounting member 10, and the bearing portion 22 formed at the body 20. The mounting member 10 and the body 20, when connected together through the hinges 5, are positioned relative to each other, and therefore the electrical connection box can be properly assembled.

Figure 5:
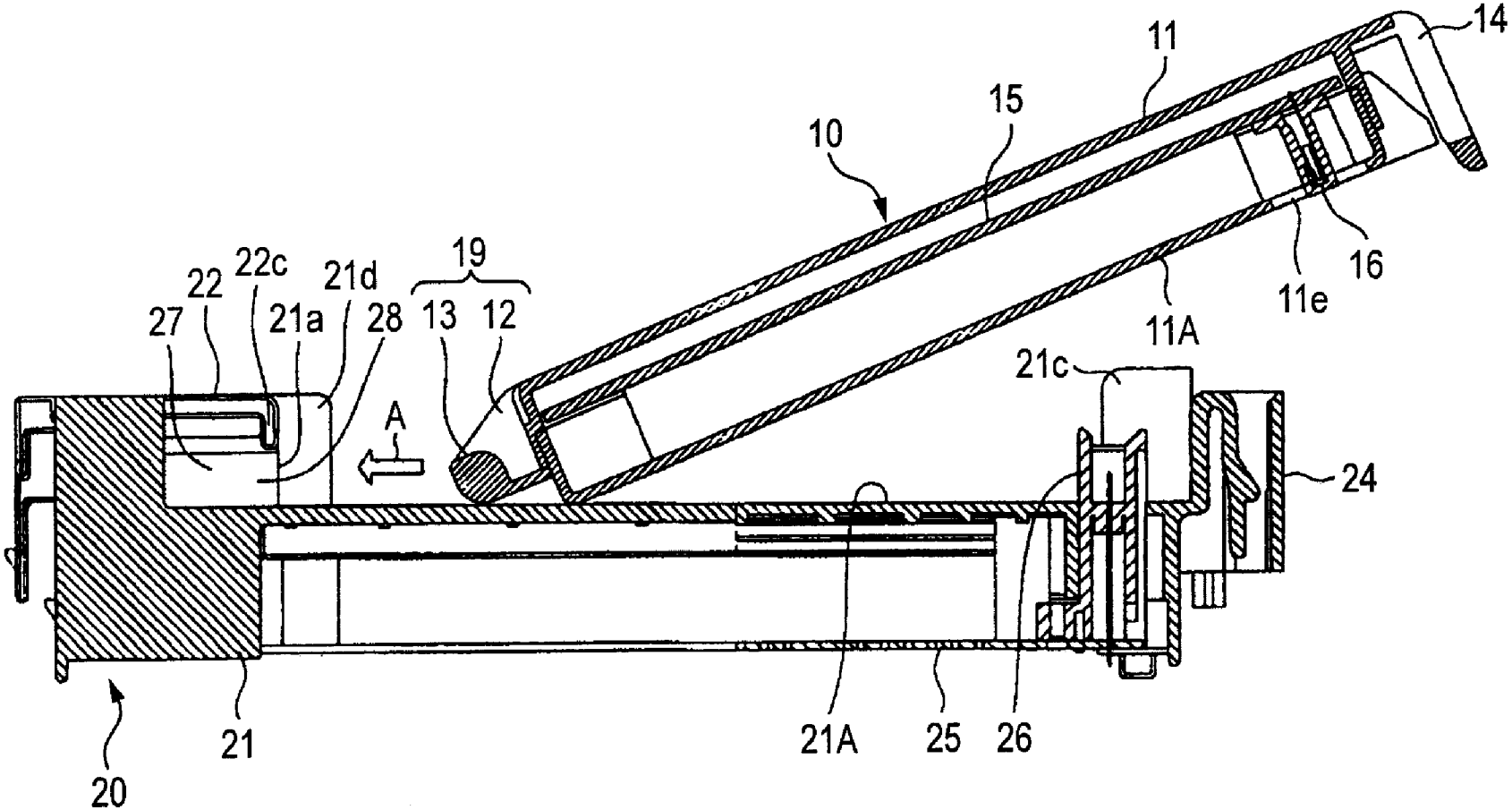
FIG. 5 is a cross-sectional view taken along the line X-X of FIG. 4, showing a condition in which the shaft portions are located on a mounting surface in the process of attaching the mounting member to the body.

The mounting member 10 includes a housing 11 made of an insulative synthetic resin, and a printed circuit board 15 (see FIG. 5). The housing 11 has a generally flattened box-like outer shape defined by six faces (or surfaces), that is, a contact surface 11A, an upper surface 11B and side surfaces 11*a*, 11*b*, 11*c* and 11*d*. The housing 11 has an internal space for receiving the printed circuit board 15 therein. The shaft portions 19 are formed on the side surface 11*a*, and a lock claw 14 is formed on the side surface 11*c* facing away from the side surface 11*a*.

The contact surface 11A is adapted to be contacted with (or abuts against) a mounting surface 21A of the body 20, and has a hole 11*e* (see FIG. 5) through which a connector mounted on the body 20 is passed when the contact surface 11A is held against the mounting surface 21A. The lock claw 14 is formed on a central portion of the side surface 11*c*, and projects downwardly (FIG. 5). When the mounting member 10 and the body 20 are contacted with each other to be combined together, the lock claw 14 fits in a lock mechanism 24 provided at a housing 21 of the body 20, thereby fixing the mounting member 10 and the body 20 to each other.

The shaft portion 19 is formed on and projects perpendicularly from the side surface 11*a*. Here, the two (a pair of) shaft portions 19 are formed respectively at opposite end portions of the side surface 11*a* disposed adjacent respectively to the side surfaces 11*b* and 11*d*. The shaft portion 19 includes a support portion 12, and an engagement portion 13.

As shown in FIGS. 1 to 9, the support portion 12 of each of the pair of shaft portions is formed by two walls, that is, a bottom wall 12*a* and a side wall 12*b*, and the two walls 12*a* and 12*b* extend perpendicularly from the side surface 11*a*. The bottom wall 12*a* is a flat plate-like wall disposed parallel to and above the contact surface 11A, and corresponds to reinforcing unit. The side wall 12*b* is connected integrally with the bottom wall 12*a* in intersecting relation thereto, and its outer surface is coplanar with the corresponding side surface 11*b* or 11*d*. The side wall 12*b* has a generally elliptic cross-section, and is gradually decreasing in size from its proximal end (disposed immediately adjacent to the side surface 11*a*) toward its distal end. The engagement portion 13 is formed at the distal end of the side wall 12*b*, and projects toward the other shaft portion 19, and the side wall 12*b* and the engagement portion 13 are formed integrally with and supported by the bottom wall 12*a*. Therefore, the bottom wall 12*a* serves to reinforce the shaft portion 19, so that the shaft portion 19 has an increased strength. In this embodiment, although the wall is used as the reinforcing unit, any other suitable reinforcing unit may be provided in order to further increase the strength. For example, three or more walls may be provided, or the thickness of the wall may be increased.

As shown in FIGS. 1 and 9 to 12, the engagement portion 13 of each of the pair of the shaft portions 19 includes a pillar portion 13*a* of a generally cylindrical shape, and a fixing claw 13*b* formed on the pillar portion 13*a*. The pair of pillar portions 13*a* are formed respectively at the distal ends of the side walls 12*b* of the support portions 12, and project toward each other in opposed relation, with their axes disposed parallel to the contact surface 11A. That end (lower end in FIG. 9) of the pillar portion 13*a* disposed close to the contact surface 11A is disposed on the upper side (see FIG. 9) of the bottom wall 12*a*, so that the pillar portion 13*a* projects upwardly from the bottom wall 12*a*. The fixing claw 13*b* has a triangular cross-section, and has a distal end edge (apex) directed upwardly. The fixing claw 13*b* is formed on the upper end (in FIG. 9) of the pillar portion 13 remote from the bottom wall 12*a* in parallel relation to the axis of the pillar portion 13. The fixing claw 13*b* is adapted to be bitingly engaged with fixing claws 22*d* (described later) of the bearing portion 22 to thereby fix the mounting member 10 and the body 20 to each other (see FIGS. 12 and 13).

In this embodiment, although the shaft portion 19 is formed by the support portion 12 and the engagement portion 13 as described above, the shaft portion 19 is not limited to this configuration, and may have any other suitable configuration in so far as it can be engaged with a projecting wall (corresponding to a limiting portion) of the bearing portion (described later). For example, the shaft portion may have an engagement portion formed at a distal end of a support portion and projecting in a direction different from a direction of extending of this support portion.

In this embodiment, the bottom wall 12*a* is disposed at a level above the mating wall 11A, and the engagement portion 13 is formed on the upper side of the bottom wall 12*a*. Therefore, if the angle of the mounting member 10 relative to the mounting surface 21A is small when the engagement portions 13 are located on the mounting surface 21A, a corner portion 11*f* (FIG. 10) formed by the contact surface 11A and the side surface 11*a* of the mounting member 10 abuts against the mounting surface 21A. Therefore, the engagement portion 13 is moved upwardly apart from the mounting surface 21A (see FIGS. 10 and 11), so that the projecting wall 22*c* prevents the engagement portion 13 from passing through an insertion port 28 as described later.

Namely, for inserting the engagement portion 13 into the bearing portion 22, it is necessary to slide the engagement portion 13 over the mounting surface 21A, and in so far as each engagement portion 13 is located on the mounting surface 21A, the inclined mounting member 10 is kept at an angle more than a certain angle. In this embodiment, the pair of shaft portions 19 are so formed and disposed that the mounting member 10 can be kept at such an angle (a predetermined angle) that connectors 26 and 16 mounted respectively at the contact surfaces of the body 20 and the mounting member 10 will not interfere with each other. However, in other embodiments of the invention, the shape and disposition of each shaft portion need to be suitably determined.

The printed circuit board 15 is a well-known printed circuit board having a CPU (central processing unit) mounted thereon, the CPU controlling relays, etc., mounted on a printed circuit board 25 (described later) received within the body 20 as shown in FIG. 5. The printed circuit board 15 is received within the housing 11 in parallel relation to the contact surface 11A, and is fixed to the housing 11 by screws or the like. The printed circuit board 15 has the connector 16 mounted thereon, and is connected to the printed circuit board 25 (described later) through this connector 16. The connector 16 includes a connector housing made of an insulative synthetic resin, and metal terminals received in this connector housing. The connector 16 is mounted on the printed circuit board 15, and extends perpendicularly therefrom toward the body 20, and is fitted to the connector 26 (mounted on the printed circuit board 25) through the hole 11*e* formed through the contact surface 11A.

As shown in FIG. 1, the body 20 includes the housing 21 made of an insulative synthetic resin, and the printed circuit board 25. The housing 21 has a generally flattened box-like outer shape, and has an internal space for receiving the printed circuit board 25 therein. The housing 21 includes the mounting surface 21A for the placing of the mounting member 10 thereon, side walls 21*a* and 21*b* and receiving walls 21*c* and 21*d* extending upwardly from edge portions of the mounting surface 21A toward the mounting member 10, the lock mechanism 24, and the bearing portions 22.

The mounting surface 21A is to be contacted with (that is, be held against) the contact surface 11A of the mounting member 10, and the side walls 21*a* and 21*b* and the receiving walls 21*c* and 21*d* extend upwardly from the edge portions of the contact surface 11A. The mounting member 10 is received in a region surrounded by these walls, and is attached to the mounting surface 21A. The mounting surface 21A has a hole 21*e* for enabling the connectors to be fitted together when attaching the mounting member 10 to the body 20.

The side wall 21*b* is disposed parallel to the direction (left-right direction in FIG. 4) of inserting of each shaft portion 19 into the corresponding bearing portion 22. The side surface 11*b* of the mounting member 10 is slid along the side wall 21*b*, and the shaft portions 19 are inserted respectively into the bearing portions 22, and by doing so, the mounting member 10 can be positioned relative to the body 2 in a direction (upward-downward direction in FIG. 4) perpendicular to the inserting direction. In this embodiment, although the side wall 21*b* is the wall extending upwardly from the mounting surface 21A, the invention is not limited to this construction, and any other suitable guide portions can be used in so far as it has a guide function of positioning the mounting member 10 relative to the body 20 in the direction perpendicular to the direction of inserting of each shaft portion 19 into the bearing portion 22.

As shown in FIG. 2, the lock mechanism 24 is provided at the end (or edge) of the mounting surface 21A, and is disposed midway between the side wall 21*b* and the receiving wall 21*c*. The lock mechanism 24 is fitted to the lock claw 14 of the mounting member 10, thereby combining and fixing the mounting member 10 and the body 20 together.

The bearing portion 22 includes the insertion port 28, a receiving portion 27, side walls 22*a* and 22*e*, an upper wall 22*b*, and the projecting wall 22*c*.

The insertion port 28 is an opening formed between a distal end of the projecting wall 22*c* (corresponding to the limiting portion) and the mounting surface 21A, and enables the shaft portion 19 to be inserted into the bearing portion 22 therethrough. The insertion port 28 is formed into a size slightly larger than the diameter of the pillar portion 13*a*. Part of a peripheral edge of the insertion port 28 is formed by the mounting surface 21A, and therefore the engagement portion 13 can be slid over the mounting surface 21A toward the bearing portion 22, and can pass through the insertion port 28.

The insertion port 28 has the size slightly larger than the diameter of the pillar portion 13*a*, and also the engagement portion 13*a* is formed on the upper side of the bottom wall 12*a* disposed above the contact surface 11A. Therefore, when the mounting member 10 is pivotally moved toward the mounting surface 21A after each engagement portion 13 passes through the corresponding insertion port 28, the corner portion 11*f* (see FIGS. 10 and 11) formed by the contact surface 11A and the side surface 11*a* of the mounting member 10 is brought into abutting engagement with the mounting surface 21A, and when this pivotal movement is further effected, each engagement portion 13 is moved upwardly apart from the mounting surface 21A. As a result, the projecting wall 22*c* and the engagement portion 13 interfere with each other, and are retainingly engaged with each other, and therefore the engagement portion 13 will not be withdrawn to the exterior through the insertion port 28, that is, the shaft portion 19 will not be disengaged from the bearing portion 22, so that the connection of body 20 and the mounting member 10 to each other through the hinges 5 is maintained.

The receiving portion 27 is a region surrounded by the side walls 22*a* and 22*e*, the upper wall 22*b*, the projecting wall 22*c* and the mounting surface 21A, and this receiving portion 27 receives the shaft portion 19 inserted thereinto through the insertion port 28. At the time when the mounting member 10 is pivotally moved to be superposed on the mounting surface 21A, the receiving portions 27 hold the respective shaft portions 19 in position, and hence the body 20 and the mounting member 10 are held in a mutually-positioned condition.

The side walls 22*a* are formed upright respectively at the opposite ends of that side of the mounting surface 21A at which the side wall 21*a* is formed, and extend upwardly from the mounting surface 21A, the side walls 22*a* being disposed in parallel relation to the side wall 21*a*. The side wall 22*e* extends upwardly from the mounting surface 21A, and this side wall 22*e* perpendicularly intersects the side wall 22*a* in continuous relation thereto. The upper wall 22*b* is connected at its peripheral edge with a distal end of the side wall 22*a* and a distal end of the side wall 22*e*, and extends parallel to the mounting surface 21A in overlapping relation thereto. The two fixing claws 22*d* of a triangular cross-section are formed on an inner surface of the upper wall 22*b*, with their distal end edges directed toward the mounting surface 21A, the fixing claws 22*d* extending parallel to the direction of inserting of the shaft portion 19. These fixing claws 22*d* are bitingly engaged with the fixing claw 13*b* of the shaft portion 19, thereby fixing the mounting member 10 and the body 20 to each other (see FIGS. 12 and 13).

The projecting wall 22*c* (corresponding to the limiting portion) extends perpendicularly from a distal end of the upper wall 22*b* toward the mounting surface 21A, and is integrally connected at its one edge with the side wall 22*e*. The insertion port 28 for the passage of the engagement portion 13 (that is, the shaft portion 19) therethrough is formed between a distal end of the projecting wall 22*c* and the mounting surface 21A. The projecting wall 22*c* is coplanar with the side wall 21*a* in continuous relation thereto. The projecting wall 22*c* is so shaped as to be retainingly engaged with the shaft portion 19 having the engagement portion 13 projecting upwardly relative to the mounting surface 21A. As each shaft portion 19 inserted in the receiving portion 27 is pivotally moved during the attaching operation, the projecting wall 22*c* and the shaft portion 19 are more positively engaged with each other, and therefore the engagement portion 13 (that is, the shaft portion 19) will not be disengaged from the projecting wall 22*c* (that is, from the bearing portion 22).

In this embodiment, although the projecting wall 22*c* (that is, the limiting portion) is supported by the side walls 22*a* and 22*e* (perpendicularly formed on the mounting surface 21A) and the upper wall 22*b*, the limiting portion is not limited to this construction, and any other suitable limiting portion may be adopted in so far as it is disposed above the mounting surface, and can be engaged with the shaft portion inserted through the insertion port formed between the limiting portion and the mounting surface, and will not be disengaged from the shaft portion even when the shaft portion is pivotally moved. Although the projecting wall 22*c* is coplanar with the side wall 21*a* in continuous relation thereto, the invention is not limited to this construction, and the positional relation of the projecting wall 22*c* (that is, the limiting portion) with other surfaces than the mounting surface is not of absolute necessity.

The printed circuit board 25 is a well-known printed circuit board having relays and fuses mounted thereon. This printed circuit board 25 is received within the housing 21 in parallel relation to the mounting surface 21A, and is fixed to the housing 21 by screws or the like. The printed circuit board 25 has the connector 26 for connecting this printed circuit board to the printed circuit board 15. The connector 26 includes a connector housing made of an insulative synthetic resin, and metal terminals received within this connector housing. The connector 26 is mounted on the printed circuit board 25, and extends upwardly from the printed circuit board 25 toward the body 20, and is fitted to the connector 16 (mounted on the printed circuit board 15) through the hole 21*e* in the mounting surface 21A. The connectors 26 and 16 are so mounted respectively on the printed circuit boards 25 and 15 as to be accurately fitted together when the mounting member 10 is attached in a superposed manner to the mounting surface 21A of the body 20.

Next, in the electrical connection box of this embodiment, a method of attaching the mounting member to the body will be described with reference to FIGS. 5 to 13.

First, the engagement portions 13 are located on the mounting surface 21A, with the mounting member 10 inclined relative to the mounting surface 21A of the body 20 at such an angle that the connectors 26 and 16 mounted respectively on the body 20 and the mounting member 10 will not interfere with each other, as shown in FIG. 5. As a result, the positioning of the mounting member 10 in the upward-downward direction (in FIG. 5) is effected. At this time, if the mounting member 10 is brought closer to the mounting surface 21A to be inclined relative to this mounting surface 21A at an angle smaller than a predetermined angle at which the connectors 26 and 16 will not interfere with each other, the corner portion 11*f* (see FIG. 10) of the mounting member 10 abuts against the mounting surface 21A, so that the engagement portions 13 are moved upwardly apart from the mounting surface 21A, and therefore each engagement portion 13 is prevented by the corresponding projecting wall 22*c* from passing through the insertion port 28. Therefore, unless the mounting member 10 is kept inclined at a proper angle, each engagement portion 13 can be inserted into the bearing portion 22.

Then, the mounting member 10, while kept inclined at the above angle, is slid in a direction of arrow A with the engagement portions 13 kept in sliding contact with the mounting surface 21*a* until the mounting member 10 is brought into abutting engagement with the side wall 21*a*. At this time, the engagement portions 13 slide over the mounting surface 21A, and also the side surface 11*b* of the mounting member 10 slides along the side wall 21*b*, and by doing so, in addition to the positioning in the upward-downward direction, the positioning in the direction from the rear side toward the front side can be effected.

Figure 6:
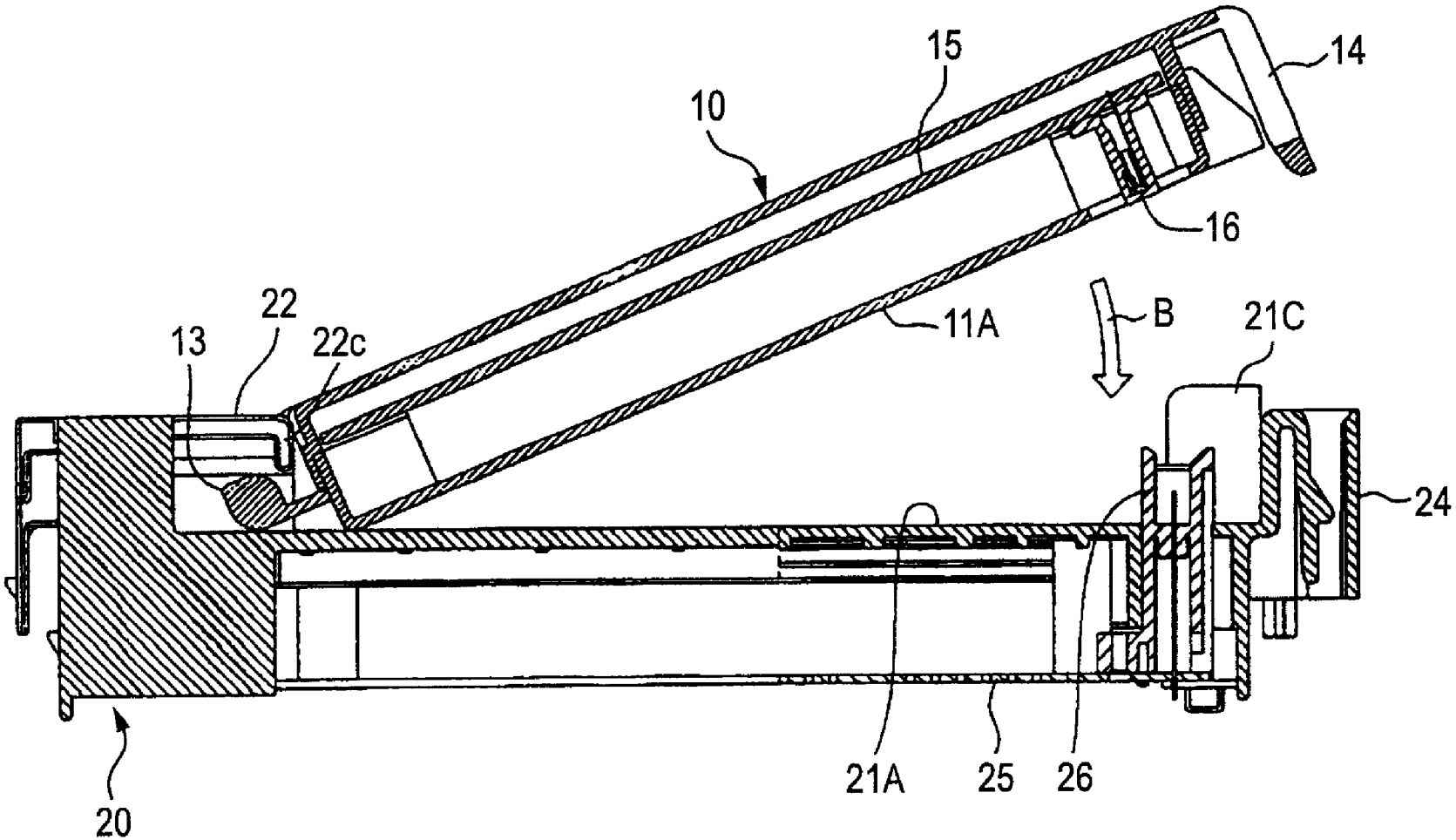
FIG. 6 is a cross-sectional view showing a condition in which the shaft portions are slid from the condition of FIG. 5 toward the bearing portions, and are inserted respectively in the bearing portions.
Figure 7:
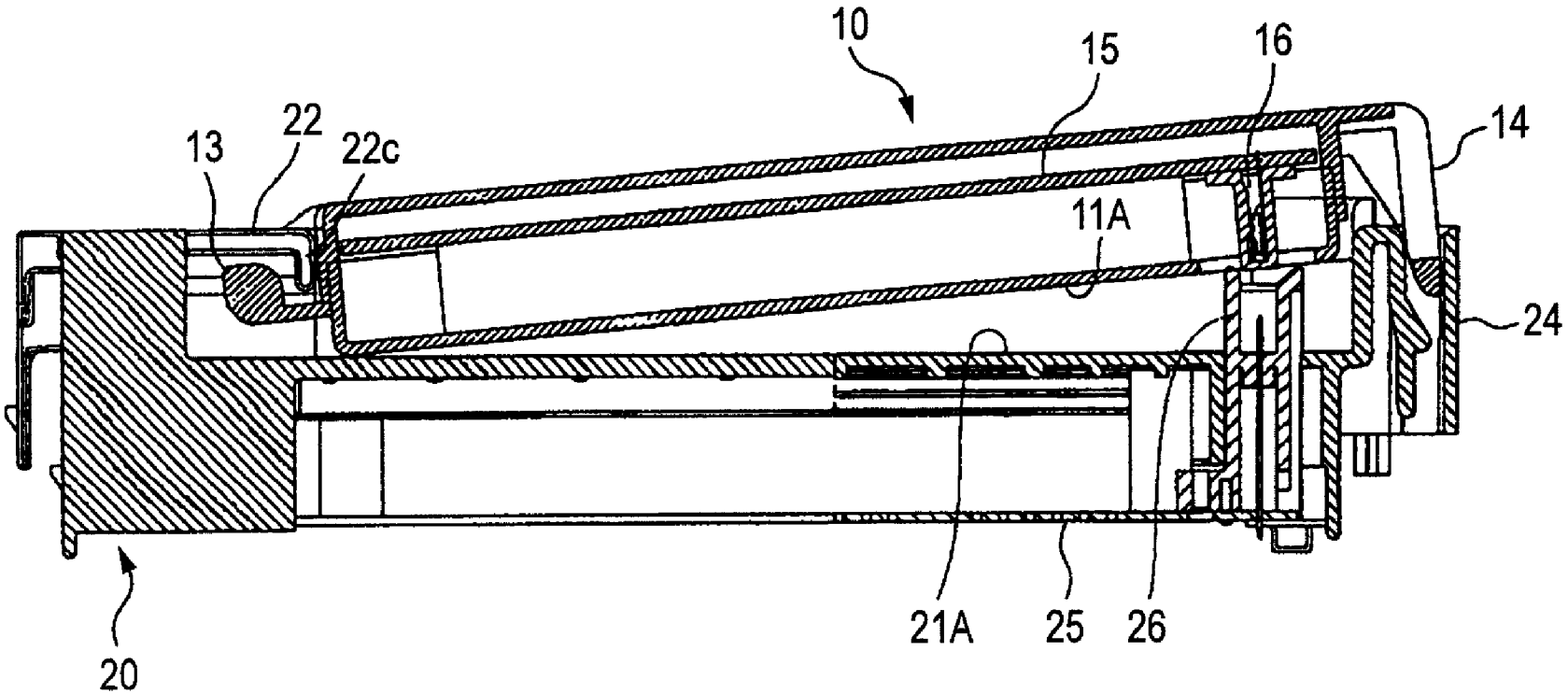
FIG. 7 is a cross-sectional view showing a condition in which the mounting member is pivotally moved from the condition of FIG. 6 toward the body about hinges.

When the mounting member 10 is slid until it is brought into abutting engagement with the side wall 21*a*, each engagement portion 13 passes through the insertion port 28, and is inserted into the receiving portion 27, and the engagement portion 13 (that is, the shaft portion 19) and the bearing portion 22 jointly form the hinge as shown in FIG. 6. Then, the mounting member 10 is pivotally moved toward the mounting surface 21A in a direction of arrow B about the hinges. When the mounting member 10 is further pivotally moved, the corner portion 11*f* (see FIG. 10) (at which the contact surface 11A and the side surface 11*a* of the mounting member 10 intersect each other) is brought into abutting engagement with the mounting surface 21A as shown in FIG. 7. Then, when the mounting member 10 is further pivotally moved, the engagement portions 13 are moved upwardly apart from the mounting surface 21A. Therefore, each engagement portion 13 interferes with the projecting wall 22*c* (that is, the limiting portion), and is retainingly engaged with this projecting wall 22*c*, and the movement of the mounting member 10 is limited such that the engagement portion 13 is located within the receiving portion 27. Namely, the positioning of the mounting member 10 for attaching purposes is effected, and thereafter the mounting member 10 will not be disengaged from the body 20. The positioning of the mounting member 10 for attaching purposes is thus effected, and therefore at the same time the positioning of the connectors 16 and 26 is effected.

Figure 8:
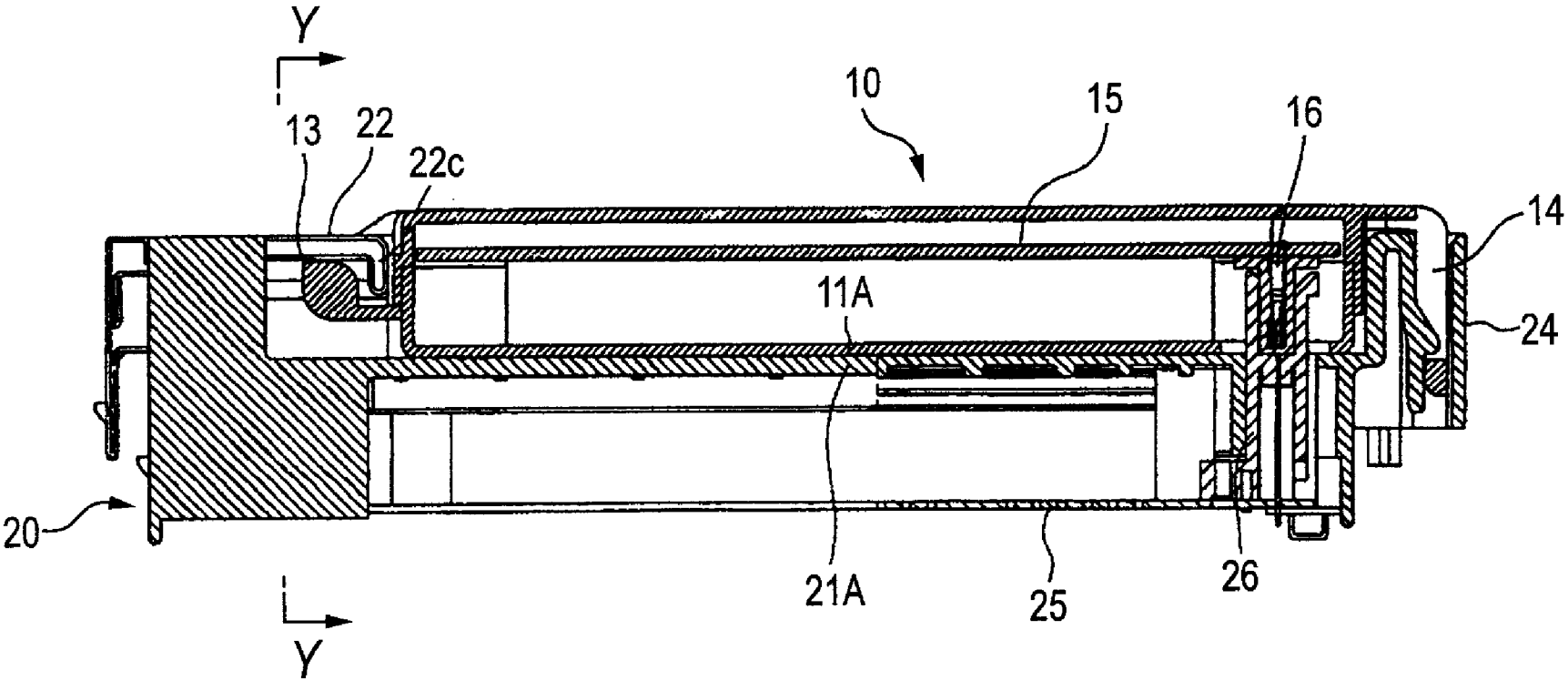
FIG. 8 is a cross-sectional view showing a condition in which the mounting member is further pivotally moved from the condition of FIG. 7, and is contacted with the mounting surface of the body.
Figure 9:
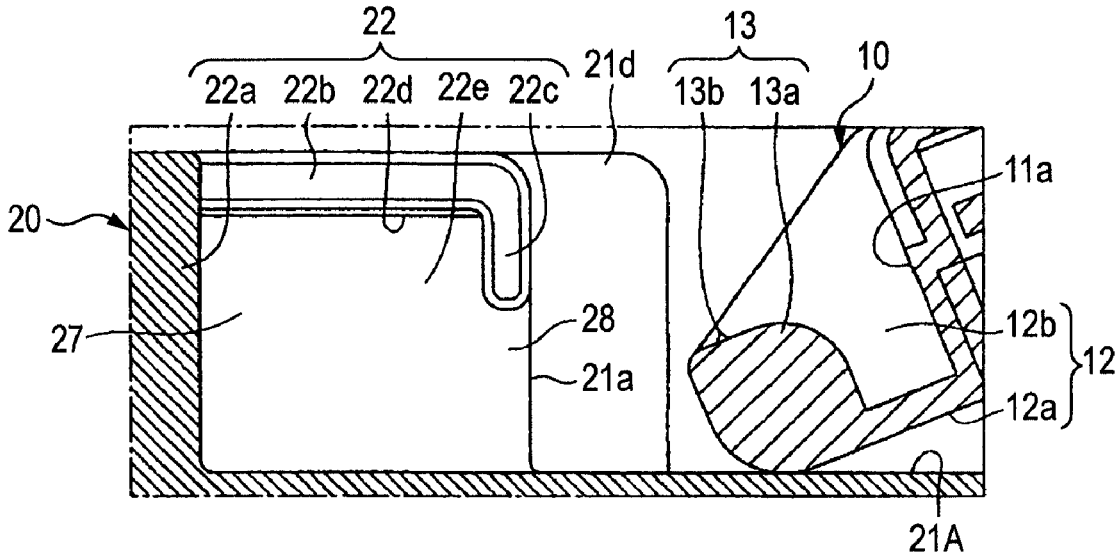
FIG. 9 is an enlarged view of the hinge portion of FIG. 5.
Figure 10:
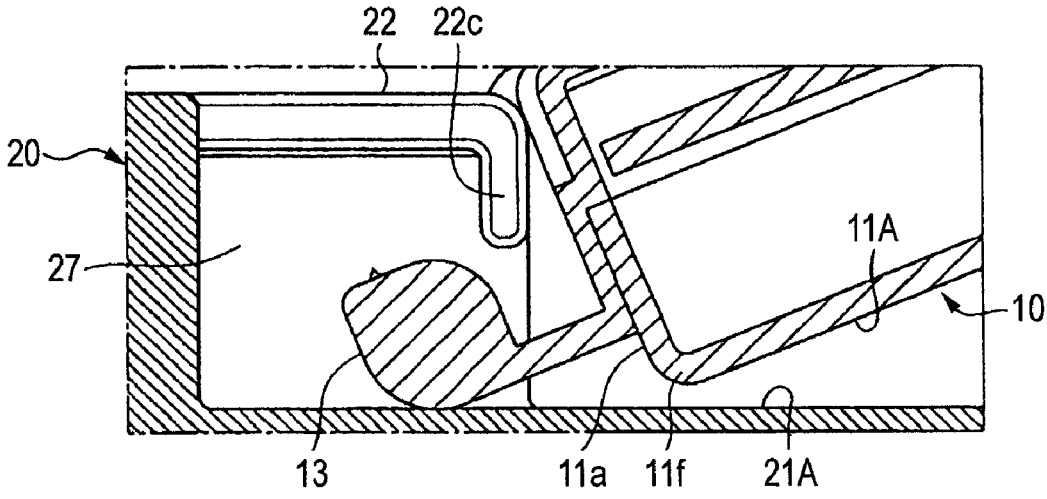
FIG. 10 is an enlarged view of the hinge portion of FIG. 6.
Figure 11:
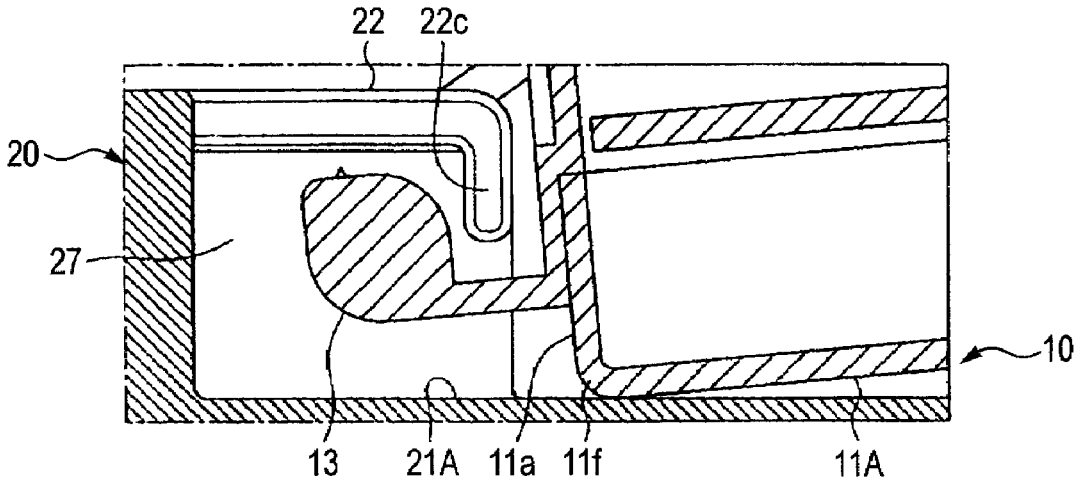
FIG. 11 is an enlarged view of the hinge portion of FIG. 7.
Figure 12:
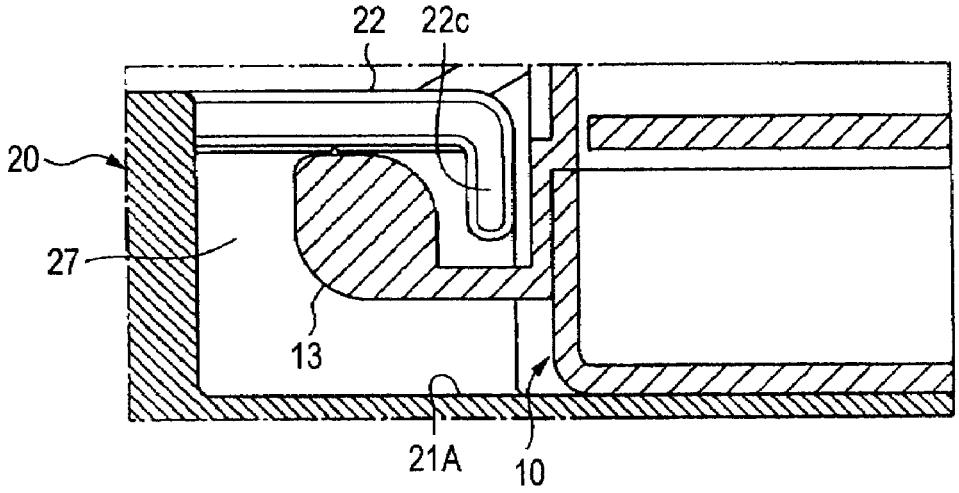
FIG. 12 is an enlarged view of the hinge portion of FIG. 8.

Then, when the mounting member 10 is pivotally moved until the contact surface 11A of the mounting member 10 is brought into contact with the mounting surface 21A of the body 20, the connectors 16 and 26 are fitted together as shown in FIG. 8, and the metal terminals within the connector 16 are contacted respectively with the metal terminals within the connector 26, so that the printed circuit boards 15 and 25 are electrically connected together. Also, the lock claw 14 and the lock mechanism 24 are fitted together, so that the mounting member 10 and the body 20 are fixed to each other at their one ends. Furthermore, the fixing claw 13*b* of each engagement portion 13 and the fixing claws 22*d* of the corresponding bearing portion 22 are bitingly engaged with each other, and the engagement portion 13 is urged by the bearing portion 22 toward the mounting surface 21A, so that the mounting member 10 and the body 20 are fixed to each other at the other ends thereof, thus assembling the electrical connection box 1.

As described above, in this embodiment, the body 20 and the mounting member 10 are connected together by the hinges 5 each formed by the shaft portion 19 and the bearing portion 22, and the bearing portion 22 has the insertion port 28 through which the shaft portion 19, while sliding over the mounting surface 21A toward the bearing portion 22, passes. Therefore, when assembling the electrical connection box 1, the shaft portions 19 of the mounting member 10 are held in contact with the mounting surface 21A of the body 20, and in this condition each shaft portion 19 is slid toward the insertion port 28, and by doing so, the shaft portion 19 can be inserted into the receiving portion 27 through the insertion port 28. Therefore, the positioning for the purpose of passing each shaft portion 19 through the insertion port 28 can be easily effected, that is, the initial positioning of the body 20 and the mounting member 10 relative to each other can be easily effected, and therefore the efficiency of the operation for assembling the electrical connection box 1 can be enhanced. The bearing portion 22 includes the receiving portion 27 for receiving the shaft portion 19 passed through the insertion port 28, and the projecting wall 22*c* (that is, the limiting portion) for preventing the shaft portion 19 from being disengaged from the receiving portion 27 when the mounting member 10 is pivotally moved. Therefore, even when the mounting member 10 is pivotally moved about the hinges 5 after the shaft portions 19 are inserted respectively into the receiving portions 27, each shaft portion 19 is held in position by the projecting wall 22*c*, and will not be disengaged from the receiving portion 27, so that the body 20 and the mounting member 10 are kept in their proper mounting positions, and therefore the efficiency of the operation for assembling the electrical connection box 1 can be enhanced.

Furthermore, in this embodiment, each engagement portion 13 is formed on the mounting member 10 in such a manner that when each engagement portion 13 is slid toward the bearing portion 22 while the mounting member 10 is kept inclined relative to the mounting surface 21A at an angle smaller than the predetermined angle at which the connectors 26 and 16 will not interfere with each other, the engagement portion 13 is prevented from passing through the insertion port 28. Therefore, in order that the engagement portion 13 can pass through the insertion port 28 to be inserted into the bearing portion 22, the angle of inclination of the mounting member 10 need to be not smaller than the above predetermined angle. Namely, the mounting member 10 is inclined at such an angle that the engagement portion 13 can pass through the insertion port 28 to be inserted into the bearing portion 22, and by doing so, the angle of inclination of the mounting member 10 is necessarily not smaller than the above predetermined angle, and the connectors 26 and 16 mounted respectively at the opposed surfaces of the body 20 and the mounting member 10 can be prevented from striking against each other. Therefore, damage of the connectors 26 and 16 due to an error during the assembling operation of the electrical connection box can be avoided, and therefore the operation for assembling the electrical connection box 1 can be positively effected.

Furthermore, in this embodiment, the printed circuit board 25 having the connector 26 mounted thereon is received within the body 20, while the printed circuit board 15 having the connector 16 mounted thereon is received within the mounting member 10, and simultaneously when the mounting member 10 is mounted on the mounting surface 21A of the body 20 in superposed relation thereto, the two connectors 26 and 16 are fitted together. Therefore, simultaneously when the body 20 and the mounting member 10 are connected together by the hinges, and are positioned relative to each other for mounting purposes, the connectors 26 and 16 are also positioned relative to each other. Therefore, simultaneously when the electrical connection box 1 is assembled, the two connectors 26 and 16 are fitted together. At this time, the two connectors 26 and 16 are accurately fitted together without striking against each other and therefore without being damaged, and therefore the efficiency of the operation for assembling the electrical connection box 1 can be enhanced.

Furthermore, in this embodiment, the body 20 has the side wall 21*b* serving as the guide portion for abutting against the mounting member 10 so as to guide the same toward the insertion ports 28. Therefore, when assembling the electrical connection box 1, the mounting member 10 is held in contact with both of the mounting surface 21A and the side wall 21*b* of the body 20, and in this condition the mounting member 10 is slid toward the insertion ports 28, and by doing so, the positioning of the mounting member 10 for passing the engagement portions 13 through the respective insertion ports 28 can be effected in the plurality of directions, and therefore the efficiency of the operation for assembling the electrical connection box 1 can be further enhanced.

Furthermore, in this embodiment, the shaft portion 19 includes the support portion 12 having the two walls (that is, the bottom wall 12*a* and the side wall 12*b* extending perpendicularly from the mounting member 10), and therefore the bottom wall 12*a* serves as the reinforcing unit for supporting the side wall 12*b* and the engagement portion 13, and can increase the strength of the shaft portion 19. Therefore, the strength of each hinge 5 can be increased, and the assembled condition of the body 20 and the mounting member 10 can be more positively maintained.

Although the above embodiment is directed to the electrical connection box, the invention is not limited to such electrical connection box, but can be applied to any other suitable structural assembling unit in which a box-like member is mounted on a member having a mounting surface.

The above embodiment merely shows a representative example of the present invention, and the invention is not limited to the above embodiment, and various modifications can be made without departing from the subject matter of the invention.

What is claimed is:

1. An electrical connection box, comprising:

a body which includes a mounting surface; and a mounting member, including a shaft portion, attached to the body, wherein the body includes a bearing portion which receives the shaft portion rotatably;

wherein the bearing portion has:

a receiving portion which receives the shaft portion;

a limiting portion provided at a position separate from the mounting surface for a predetermined distance; and an insertion port, having a length of the predetermined distance defined by the mounting surface and the limiting portion, through which the shaft portion is inserted into the receiving portion; and wherein the limiting portion limits a movement of the shaft portion in a direction parallel to the mounting surface based on an inclining condition of the mounting member.

2. The electrical connection box according to claim 1, wherein the mounting member includes a contact surface face-contacted with the mounting surface when the mounting member is attached to the body; and wherein the shaft portion is provided far from the contact surface in a direction perpendicular to the contact surface.

3. The electrical connection box according to claim 1, wherein the limiting portion allows the inserting movement of the shaft portion in which the shaft portion is inserted into the receiving portion in a first inclining condition of the mounting member; and wherein the limiting portion limits the inserting movement of the shaft portion in a second inclining condition of the mounting member.

4. The electrical connection box according to claim 3, wherein in the first inclining condition, an angle of the mounting member to the mounting surface is larger than a predetermined angle so that a distance between a top of the shaft portion and the mounting surface is smaller than the length of the insertion port.

5. The electrical connection box according to claim 3, wherein in the second inclining condition, an angle of the mounting member to the mounting surface is smaller than or equal to a predetermined angle so that a distance between a top of the shaft portion and the mounting surface is longer than the length of the insertion port.

6. The electrical connection box according to claim 1, wherein the body includes a first printed circuit board having a first connector mounted thereon;

wherein the mounting member includes a second printed circuit board having a second connector mounted thereon; and wherein when the mounting member is attached to the body, the first connector is mated to the second connector to electrically connect the first printed circuit to the second printed circuit.

7. The electrical connection box according to claim 1, wherein the shaft portion has a reinforcing unit interposed between the shaft portion and the mounting member to reinforce the shaft portion.

8. An assembling method of an electrical connection box, comprising:

providing a body which includes a mounting surface and a bearing portion, the bearing portion having a limiting portion; and providing a mounting member which includes a shaft portion;

sliding the mounting member toward the bearing portion along the mounting surface of the body to insert the shaft portion into the bearing portion; and rotating the mounting member to a direction of the mounting surface about the shaft portion so as to attach the mounting member to the body.

9. The assembling method according to claim 8, wherein, in the sliding process, the mounting member is inclined in a condition in which an angle of the mounting member to the mounting surface is set to be larger than a predetermined angle.

* * * * *